US005363174A

United States Patent [19]

Magde, Jr. et al.

[11] Patent Number: 5,363,174

[45] Date of Patent: Nov. 8, 1994

[54] METHOD AND APPARATUS FOR BACKGROUND CONTROL IN AN ELECTROSTATOGRAPHIC PRINTING MACHINE

[75] Inventors: John M. Magde, Jr., Webster; Thomas F. Szlucha, Fairport, both of N.Y.

[73] Assignee: Xerox Corporation, Stamford, Conn.

[21] Appl. No.: 169,099

[22] Filed: Dec. 20, 1993

[51] Int. Cl.[5] ..... G03G 15/00; G03G 15/052; G03G 15/06; G03G 15/04

[52] U.S. Cl. ..... 355/208; 355/214; 355/219; 355/246; 355/69

[58] Field of Search ..... 355/208, 214, 69, 246, 355/219

[56] References Cited

U.S. PATENT DOCUMENTS

| | | | |
|---|---|---|---|
| 4,372,674 | 2/1983 | Yukawa et al. | 355/14 D |
| 4,831,410 | 5/1989 | Adams et al. | 355/208 |
| 4,912,508 | 3/1990 | Zawadzki et al. | 355/208 |
| 5,282,000 | 1/1994 | Miyake | 355/208 |
| 5,303,006 | 4/1994 | Mizude | 355/219 X |
| 5,305,059 | 4/1994 | Kurosawa | 355/208 |

*Primary Examiner*—R. L. Moses
*Attorney, Agent, or Firm*—Denis A. Robitaille

[57] ABSTRACT

A method and apparatus for determining the presence of image information in the lead edge of an input document by comparing the average difference between a plurality of instantaneous optical density measurements of a reference strip and the average optical density for the reference strip to the average difference between a plurality of instantaneous optical density measurements of a lead edge of an original input document and the average optical density for the lead edge of the original input document. Analysis of optical density measurements during scanning of the lead edge of an original input document is accomplished so that image information on the lead edge of an original input document is not misinterpreted as indicative of a dark background original input document. The method and apparatus provides novel control of bias voltages applied to subsystems in an electrostatographic printing apparatus in response to the presence or absence of image information in the lead edge of an input document so that both background development and the loss of image density for images on the lead edge of a document is minimized by setting the exposure lamp voltage, and/or the developer bias, charging potential, as well as other variable parameters to predetermined settings in response to the detection of image information in the original input document.

15 Claims, 3 Drawing Sheets

METHOD AND APPARATUS FOR BACKGROUND CONTROL IN AN ELECTROSTATOGRAPHIC PRINTING MACHINE

The present invention relates generally to electrostatographic printing machines, and more particularly, concerns a method and apparatus for providing exposure control for preventing inappropriate background development suppression in electrostatographic printing applications.

Generally, the process of electrostatographic copying is initiated by exposing a light image of an original document to a substantially uniformly charged photoreceptive member. Exposing the charged photoreceptive member to a light image discharges the photoconductive surface thereof in areas corresponding to non-image areas in the original input document while maintaining the charge in image areas to create an electrostatic latent image of the original document on the photoconductive surface of the photoreceptive member. This latent image is subsequently developed into a visible image on the photoreceptive member by a process in which charged toner particles are deposited onto the photoconductive surface of the photoreceptor via an electrically biased developer electrode such that the toner particles are attracted to the charged image areas thereon. The toner particles are then transferred from the photoreceptive member to a copy sheet on which the image may be permanently affixed to provide a reproduction of the original document. In a final step, the photoreceptive member is cleaned to remove any residual developing material from the photoconductive surface in preparation for subsequent imaging cycles.

The described etectrostatographic printing process is well known and is useful for light lens copying from an original input document, as well as for printing applications from electronically generated or stored originals. Analogous processes also exist in other electrostatographic applications such as, for example, ionographic applications, where charge is deposited on a charge retentive surface in accordance with an image stored in electronic form.

Original input documents that are being reproduced often vary considerably in terms of background image or color, resulting in different phototopic densities. For example, white documents may have absolute densities that range from 0.04 to 0.20 depending on factors such as quality and age. Other documents having colored or non-white backgrounds may have phototopic densities as high as 0.50. In the absence of compensating techniques, copiers or printers designed to reproduce large areas respond to an absolute level of input density and tend to produce unacceptable background imaging when copying non-white background documents. Various compensating techniques, known as background suppression or background stabilization, have been successfully implemented to reduce this undesirable result. For example, it is known to provide manual background stabilization in the form of a range of copy contrast settings on the control panel of a copier, whereby the high density background from a non-white original is suppressed by selecting a reduced contrast mode which typically increases exposure, increases developer bias, or performs a combination of the two. This technique has the disadvantage of being a hit-or-miss technique, causing considerable delays in the copying operation until the desirable compensation settings are found for the particular document.

Various approaches and solutions to the problems of background development are known in the prior art and have been disclosed. In particular, a thorough summary of diverse automatic background stabilization and suppression techniques is presented in U.S. Pat. No. 4,831,410, which is hereby incorporated by reference. Additionally, it is noted that the model 5017 copier/-printer manufactured by Fuji Xerox incorporates an "Automatic Exposure Control" feature for controlling exposure lamp voltage to prevent background development in the body of a copy sheet. The present invention is directed toward an improved automatic exposure control method, wherein an optical input sensor and control circuitry are provided for differentiating between color background and information in the lead edge of an input copy sheet. Information in the lead edge region is detected as a variation in the signal from the optical input sensor, such that the presence of a significant variation relative to a standard deviation characteristic provides an indication that information is printed on the lead edge. An indication that printed information exists is used to alter biasing voltages applied to various xerographic subsystems. In this manner, normal background compensation techniques may be overridden or enhanced by adjusting the exposure level or other adjustable components in response to the existence of variations detected in an optical input sensor signal.

The following disclosures may be relevant to various aspects of the present invention:

U.S. Pat. No. 4,372,674
Patentee: Yukawa et al.
Issued: Feb. 8, 1983

U.S. Pat. No. 4,831,410
Patentee: Adam et al.
Issued: May 16, 1989

U.S. Pat. No. 4,912,508
Patentee: Zawadzki et al.
Issued: Mar. 27, 1990

The relevant portions of the foregoing disclosures may be briefly summarized as follows:

U.S. Pat. No. 4,372,674 discloses a copying machine having detectors for the background color and density of the original for facilitating creation of an improved quality reproduction of an original to be copied. The apparatus of that patent includes a first sensor for producing a signal in accordance with the density of the background of the original, a second sensor for producing a signal in accordance with the color of its background, and an electronic circuit for generating a bias voltage for application to a developing apparatus based on the sensed density and color of the background of the original.

U.S. Pat. No. 4,831,410 discloses a flash exposure photocopier having a mechanism for automatically controlling photoreceptor exposure levels to compensate for the effects of documents having backgrounds of different densities. The exposure control system of that patent utilizes a sensor array located such that an image of an input document is projected onto the array coincident with flash illumination of the document, and a comparator circuit for comparing photocurrents detected by the array to an established reference level for quenching the exposure level in response to the comparator circuit.

U.S. Pat. No. 4,912,508 discloses an automatic background control for an electrostatic copier having a sensor in the optical path to sense the background of the document in the copy mode during the scanning of the document for adjusting the illumination of the document. The apparatus of that patent also includes a control to adjust the charging potential on the photoconductor in response to a non-white document background.

In accordance with the present invention, an electrostatographic printing apparatus for producing a copy of an original input document having image information and background thereon is disclosed, comprising: an imaging member; an imaging system for transmitting a light image of the original input document onto the imaging member to produce a latent image of the original input document thereon; sensing means for sensing optical density of the transmitted light image; and means, coupled to the sensing means, for detecting image information in the transmitted light image.

In accordance with another aspect of the present invention, a method of detecting a presence of image information in a lead edge of an original input document having image information and background thereon is provided, comprising the steps of: incrementally scanning a reference strip to provide an instantaneous optical density measurement thereof; retrieving a plurality of instantaneous optical density measurements of the reference strip; calculating an average optical density for the reference strip from the plurality of instantaneous optical density measurements thereof; calculating an average difference between the plurality of instantaneous optical density measurements of the reference strip and the average optical density for the reference strip; incrementally scanning a lead edge of the original input document to provide an instantaneous optical density measurement thereof; retrieving a plurality of instantaneous optical density measurements of the lead edge of the original input document; calculating an average optical density for the lead edge of the original input document from the plurality of instantaneous optical density measurements thereof; calculating an average difference between the plurality of instantaneous optical density measurements of the lead edge of the original input document and the average optical density for the lead edge of the original input document; comparing the average difference between the plurality of instantaneous optical density measurements of the reference strip and the average optical density for the reference strip to the average difference between the plurality of instantaneous optical density measurements of the lead edge of the original input document and the average optical density for the lead edge of the original input document; and providing, in response to the comparing step, a determination of whether image information is present in the lead edge of the original input document.

These and other aspects of the present invention will become apparent from the following description in conjunction with the accompanying drawings in which.

While the present invention will be described in connection with a preferred embodiment thereof, it will be understood that it is not intended that the invention be limited to this preferred embodiment. On the contrary, the present invention is intended to cover all alternatives, modifications, and equivalents as may be included within the spirit and scope of the invention as defined by the appended claims.

Figure 3:
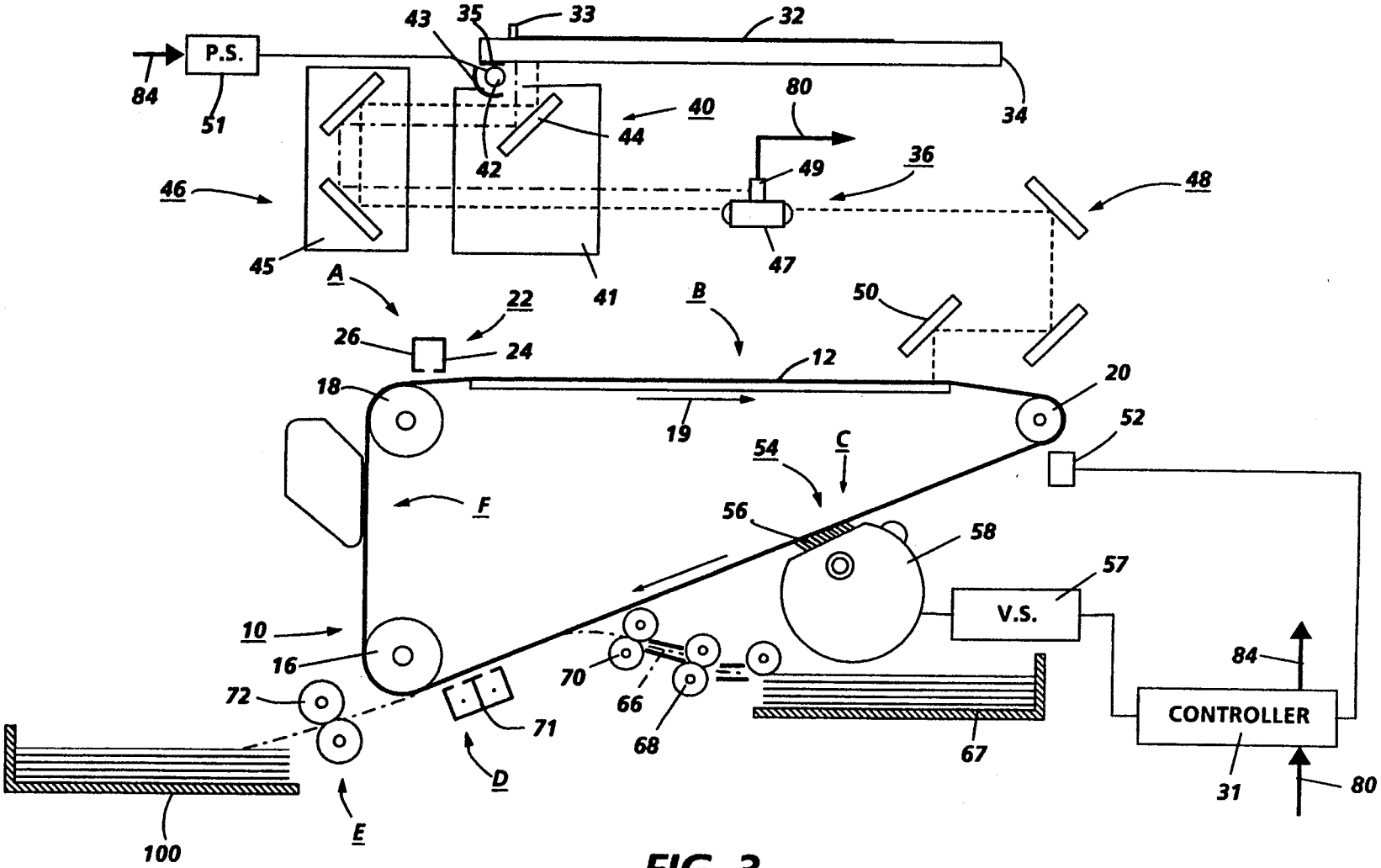
FIG. 3 is a schematic elevational view of an electrophotographic copier incorporating the features of the present invention.

For a general understanding of the features of the present invention, reference is made to the drawings and the reference numerals contained therein for designating specific elements. Referring initially to FIG. 3, a schematic depiction of the various components of an exemplary electrophotographic reproducing apparatus incorporating the automatic exposure control system of the present invention is provided. Although the apparatus of the present invention is particularly well adapted for use in an automatic electrophotographic reproducing machine, it will become apparent from the following discussion that the present automatic exposure control system is equally well suited for use in a wide variety of electrostatographic processing machines and is not necessarily limited in its application to the particular embodiment or embodiments shown or described herein.

Inasmuch as the art of electrophotographic printing is well known, the various processing stations employed in the FIG. 3 printing machine will be shown schematically and their operation will be described briefly with reference thereto. The exemplary electrophotographic reproducing apparatus of FIG. 3 employs a belt 10 having a photoconductive surface layer deposited on an electrically grounded conductive substrate. A drive roller 16, coupled to a motor, not shown, engages with belt 10 to move the belt about a curvilinear path defined by the drive roller 16, and rotatably mounted tensioning rollers 18 and 20. This system of rollers is used for advancing successive portions of the photoconductive surface on belt 10 about a curvilinear path, in the direction of arrow 19, through various processing stations disposed about the path of movement thereof, as will be described.

Initially, a portion of belt 10 passes through charging station A, where a corona generating device, generally indicated by reference numeral 22, or any other charging device charges photoconductive surface 12 to a relatively high, substantially uniform potential. Corona generating devices suited for this purpose are well known and generally comprise a charging electrode 24 partially surrounded by a conductive shield 26.

Once charged, the photoconductive surface of belt 10 is advanced to imaging station B where an original input document is exposed to a light source for forming a light image of the original input document. The light image is reflected and transmitted onto belt 10 to selectively dissipate the charge thereon, for recording an electrostatic latent image corresponding to the original document onto the photoconductive surface of belt 10. The original document 32 is positioned, either manually or by a document feeder mechanism (not shown), on the surface of a transparent platen 34, abutting registration edge 33. A white reference strip 35 is positioned under the platen 34, just outside the document scan area for providing a reference measurement point for the automatic exposure system of the present invention, as will be described.

Optics assembly 36 contains optical components which incrementally illuminate and scan the document 32 and project a reflected optical image onto the surface of belt 10. Shown schematically, these optical components comprise an illumination scan assembly 40, including illumination lamp 42, associated reflector 43 and scan mirror 44, wherein all three components are mounted on a scan carriage, generally indicated by reference numeral 41. The scan carriage 41 is adapted to travel along a path parallel to and beneath the platen 34. Lamp 42 illuminates an incremental line portion of document 32 such that a light image thereof is reflected by scan mirror 44 to corner mirror assembly 46 mounted on a second scan carriage 45 moving at ½ the rate of scan carriage 41.

The light image of the original input document 32 is projected through lens 47 and reflected by a second corner mirror 48 to belt mirror 50. These mirrors 48, 50 both move at a predetermined relationship so as to transmit the projected image onto the surface of belt 10 while maintaining the required rear conjugate to form an electrostatic latent image corresponding to the informational areas contained within original document 32.

In accordance with the present invention, the level of illumination within the optical path between the original document 32 and the belt 10 can be measured in order to control the voltage applied to various subsystems, such as, for example, the exposure lamp 42 for increasing or decreasing the intensity thereof in response to the level of illumination sensed in the optical path. In the illustrated embodiment of FIG. 3, an optical sensor 49 is connected to a controller 31 and disposed near lens 47 in the optical path of the image projected from original document 32. By way of example an adjustable illumination power supply 51 is controlled by optical sensor 49 via controller 31 for supplying selectively variable power to lamp 42. In a preferred embodiment the optical sensor 49 includes a solid state photosensor array comprising a multi-element charge-coupled device (CCD) array of sufficient width to monitor the entire image projected through the imaging station B. The details of the illumination system as well as the specific features thereof and the interaction between the optical sensor 49, the controller 31, and the various subsystems including the exposure lamp 42, will be discussed in greater detail herein with reference to FIGS. 1–2.

Continuing with a description of FIG. 3, the belt then advances past a DC electrometer 52 positioned adjacent to the photoconductive surface of belt 10 between the exposure station B and development station C for generating a signal proportional to the dark development potential on the photoconductive surface, representing the charge maintained on the photoconductor after charging and exposure. Preferably, the electrometer 52 is a nulling type device having a probe and head assembly (not shown) whereby the potential of the probe is raised to the potential of the surface being measured. The generated signal is transmitted to controller 31 such as, for example, an M 37702 microprocessor manufactured by Mitsubishi Electric Co., through suitable conversion circuitry. The controller 31 may also be electrically connected to a high voltage power supply through suitable interface logic for controlling the exposure lamp, as previously discussed, or for controlling the bias voltage on the conductive shield 26 of the charging corotron in response to the generated signal from the electrometer 52 to adjust the charge applied to the photoconductive surface of belt 10. Additionally or alternatively, the controller 31 may also be coupled to the developer roller 56 for providing dynamic control of the developer bias, as will be described.

Next, the belt 10, having an electrostatic latent image recorded on the photoconductive surface thereof, advances to development station C where a magnetic brush development system, indicated generally by the reference numeral 54, advances developing material into contact with the electrostatic latent image on the surface of belt 10. Preferably, the magnetic brush development system 54 includes a developer roller 56 disposed in a developer housing 58 where toner particles are mixed with carrier beads, creating an electrostatic charge therebetween which causes the toner particles to cling to the carrier beads to form developing material. The developer roller 56 rotates and collects this developing material to produce a magnetic brush having developing material magnetically attached thereto. As the magnetic brush continues to rotate, the developing material is brought into contact with the photoconductive surface of belt 10 such that the electrostatic latent image thereon attracts the toner particles away from the carrier beads, forming a developed toner image on the photoconductive surface.

In a magnetic roll developing system as described hereinabove, a DC voltage source, as for example voltage source 57, is typically applied to the developer roller 56 for the purpose of creating an additional electrostatic field in the development zone adjacent to belt 10. This DC bias generally has a polarity opposite that of the toner for adjusting and enhancing copy quality. By increasing this bias voltage, the field between the developing material and the toner is increased such that a greater charge is needed on the photoconductive surface of belt 10 for attracting toner particles from the carrier beads, thereby decreasing the amount of toner that shifts to low charge areas on the photoconductive surface of the belt 10. Conversely, lowering the bias voltage applied to the developer roller 56 translates to a lower field strength required to shift toner particles from the carrier beads to the photoconductive surface of the belt 10. This variable developer bias can be provided by coupling voltage source 57 to controller 31 for adjusting the voltage applied to the developer roller 56 to provide optimum development of the electrostatic latent image.

After the toner particles have been deposited onto the electrostatic latent image for development thereof, belt 10 advances the developed image to transfer station D, where an output copy sheet 66, taken from a supply tray 67, is moved into contact with the developed toner image via a pair of feed rollers 68 and 70. Transfer station D includes a corona generating device 71 which projects ions onto the back side of sheet 66, thereby attracting the toner image from the surface of belt 10 to sheet 66.

After transfer, the sheet is transported to fusing station E for permanently affixing the transferred image to the copy sheet 66. Fuser station E preferably comprises a heated fuser roller 72 positioned opposite a support roller, each roller being spaced relative to one another for receiving a sheet 66 therebetween. The toner image is thereby forced into contact with the copy sheet 66 to permanently affix the toner image to the copy sheet 66. After fusing, the copy sheet 66 is delivered to receiving tray 100 for subsequent removal of the finished copy by an operator.

Invariably, after the copy sheet 66 is separated from the photoconductive surface of belt 10, some residual developing material remains in contact with belt 10. Thus, a final processing station, namely cleaning station F, is provided for removing residual toner particles from the surface of belt 10 subsequent to separation of the copy sheet 66 therefrom. Cleaning station F can include a rotatably mounted fibrous brush (not shown) for physical engagement with the photoconductive surface of belt 10 to remove toner particles by rotation of the brush thereacross. Removed toner particles are stored in a cleaning housing chamber (not shown). Cleaning station F can also include a discharge lamp (not shown) for flooding the photoconductive surface with light in order to dissipate any residual electrostatic charge remaining thereon in preparation for a subsequent charging and imaging cycle.

The foregoing description should be sufficient for purposes of the present application for patent to illustrate the general operation of an electrophotographic reproducing apparatus incorporating the features of the present invention. As described, an electrophotographic reproducing apparatus may take the form of any of several well known devices or systems. Variations of specific electrostatographic processing subsystems or processes may be expected without affecting the operation of the present invention.

As described hereinabove, an optical sensor 49 is positioned in the optical path for monitoring incremental segments of a document 32 as it is scanned by the illumination scan assembly 40. The sensor 49 is therefore capable of monitoring the entire length of the platen 34 and any documents supported thereon to provide a signal, indicated by reference numeral 80, to the controller 31, in response to a suitable timing signal therefrom. The optical sensor 49 produces an indication of optical density at any preselected or designated location along the platen 34 such that the optical density along a document being scanned, as well as the white reference strip (FIG. 1), can be provided. An exemplary optical sensor system, and control circuitry therefore, is disclosed in U.S. Pat. No. 4,912,508, the entire contents of which are incorporated by reference herein.

In typical operation, the optical sensor 49 provides a signal in response to the optical density of light reflected from the white reference strip 35. In addition, the optical sensor 49 detects the lead edge of the document 32 on the platen 34, producing a signal 80 which is provided to the controller 31. In response to a comparison of these signals, the controller 31 generates an illuminator bias signal, represented by arrow 84, which is transmitted to power supply 51 of lamp 43 to adjust the lamp voltage until the reflected light from the document reaches some predetermined target value. Thus, as the original document 32 is scanned, the optical sensor 49 determines the optical density or amount of background and/or the color of the original document 32 and transmits this information via signal 80 to controller 31. In response, the controller 31 provides an output signal 84 to power supply 51 for adjusting the illumination level of lamp 43 to eliminate background development that will appear on the copy sheet. In addition, the controller 31 may provide output signals to control the biasing voltages applied to the corona generating device 22 and the developer roll 56, as desired to produce an optimum output copy. In one known system, as described in previously referenced U.S. Pat. No. 4,912,508 initial adjustment of the lamp voltage occurs in a lead edge area, say the first 320 milliseconds of document processing (corresponding to approximately 7 mm of the input document). Thereafter, control of the lamp voltage is switched from control by the optical sensor 49 to a constant voltage control.

The practice of automatic exposure control as described hereinabove, does not take into account the possibility that image information may be present in the lead edge region of the original input document. The presence of image information on this lead edge may result in an improper indication of the optical density of the original input document from sensor 49 such that the biasing voltage applied to illumination lamp 42, as well as to the corona generating device 22 and to the developer roll 58, may be improperly adjusted via controller 31. Thus, the presence of image information on the leading edge of an original input document 32 can cause the control system to erroneously alter voltage bias settings to eliminate background development as in the case of colored papers. That is, if image information exists in the printed area being monitored by the optical sensor 49, an automatic exposure control system as described hereinabove may respond by inappropriately increasing the lamp voltage. This can result in overexposed copies depending on the optical density of the image information in the area monitored by the optical sensor 49. The present invention monitors the optical density measurements to provide a determination of variability, or "noise", in the optical density measurements from the optical sensor 49. The presence of variability in this signal represents the presence of image information such that the auto-exposure control system should be bypassed, thereby setting the biasing voltages applied to the appropriate subsystems to the default parameters for a white input document or, alternatively, for providing some additional adjustment to the biasing voltages applied to the various subsystems.

Figure 1:
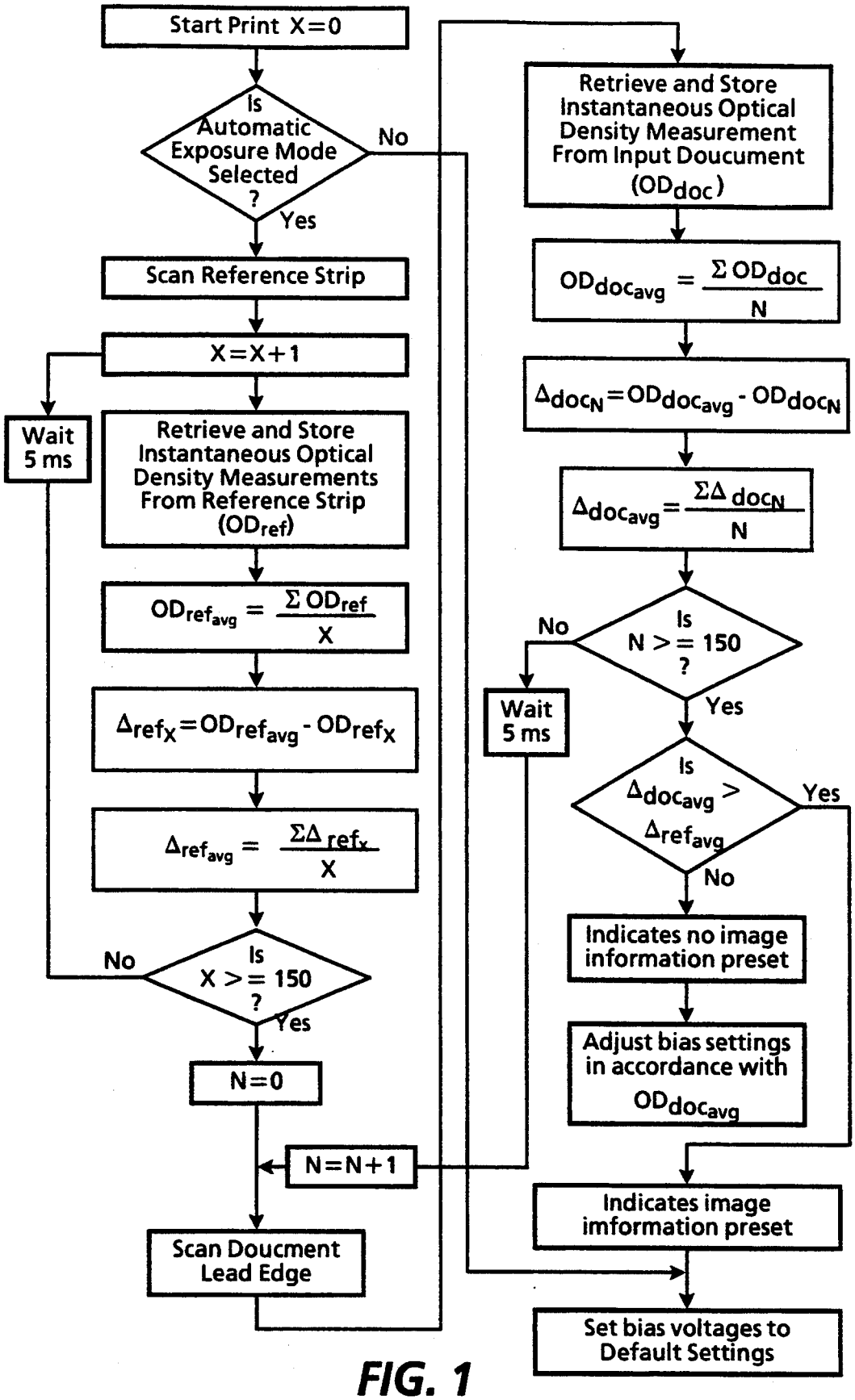
FIG. 1 is a flowchart depicting a sequence of operating steps for automatic background control as provided by the present invention.

An exemplary control algorithm or routine for monitoring variations in the signal from optical sensor 49 in order to detect the presence of image information in an optical density signal is shown in the form of a flowchart in FIG. 1. As shown in the flowchart of FIG. 1, in order to initiate the process described herein, an operator must select the automatic exposure mode, typically accomplished via a switch (not shown) located on a control panel associated with the electrostatographic machine. It will be recognized, however, that the automatic exposure mode may be incorporated as a preset or default mode for the machine such that switch activation is not necessarily required for initiating the automatic exposure control process. If the automatic exposure mode is not enabled, the bias voltages for the various subsystems are set to either a default or a manual setting.

In an initial portion of the routine, a reference value is established by scanning the white reference strip 35 prior to the actual scanning of the lead edge of the input document 32. This routine is initiated by incrementing a counter and simultaneously retrieving and storing multiple instantaneous optical density measurements ($OD_{ref}$), retrieved from optical sensor 49, in response to a timing signal. These measurements are summed and averaged to provide an average optical density for the white reference strip ($OD_{refavg}$). Thereafter, the difference between a present instantaneous optical density measurement and the average optical density for the white reference strip ($OD_{ref}$- $OD_{refavg}$) and an average of this difference ($\Delta_{refavg}$) is computed and maintained. In addition, an average difference between all of the instantaneous optical density measurements for the white reference strip and the average optical density ($\Delta_{refavg}$). The sequence of computations described above is carried out for each incremental retrieval of an optical density measurement for the white reference strip and a counter is concurrently incremented until a predetermined area has been scanned. This area can be defined by a predetermined number of instantaneous optical density measurements. As shown in FIG. 1, an updated instantaneous optical density measurement and the concommitent calculations described above are made in 5 millisecond intervals until the counter is incremented to 150, equivalent to 750 milliseconds, or approximately ½ to ¾ inch of the reference strip. In addition, an average difference between all of the instantaneous optical density measurements for the white reference strip and the average optical density ($\Delta_{refavg}$).

Figure 2:
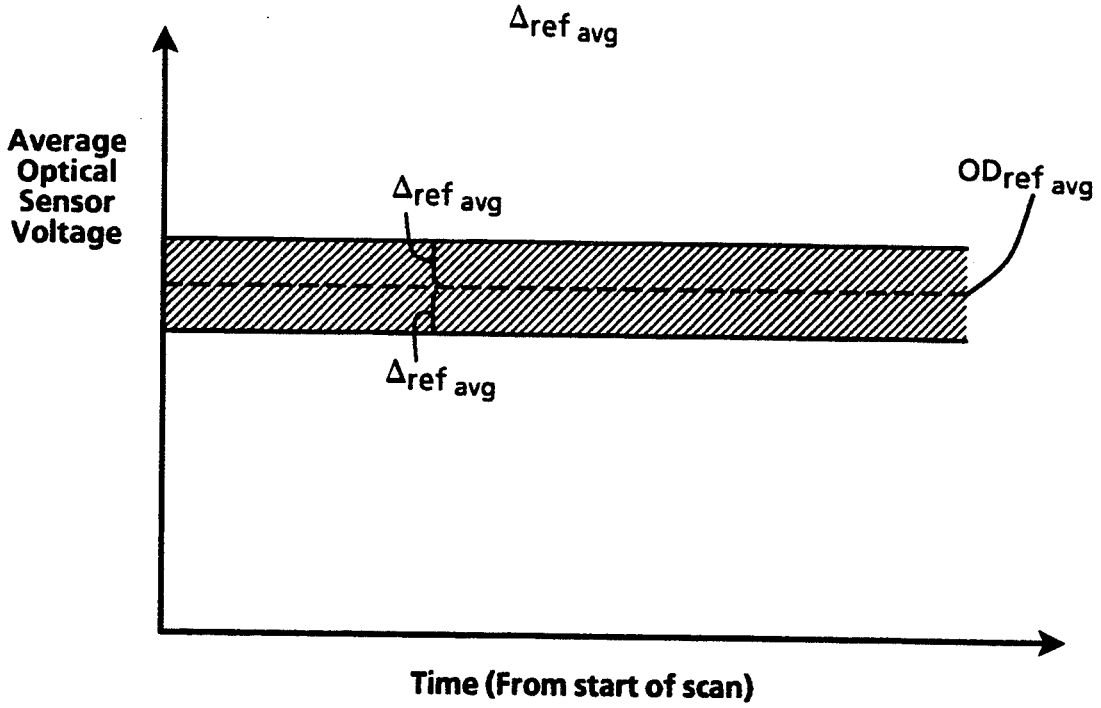
FIG. 2 is a graphic representation of an average voltage signal and the average variation in a voltage signal from an optical sensor with respect to time during the processing of the lead edge of a copy sheet having no image information therein.

The results of these computations are illustrated graphically in FIG. 2, wherein the average difference ($\Delta_{refavg}$) will be utilized as a reference value for indicating whether or not image information exists in the lead edge of the input document. It will be recognized that the optical density variation resulting from scanning reference strip 35 may be generated by many factors, such as, variances within electrical components making up the optical sensor, electrical noise, dust on the reference strip, among others.

Once the reference scan and associated value computations, as described above, have been completed, the input document lead edge is scanned to determine whether image information exists in the lead edge of the input document as well as whether background color is present in the input document. This routine is similar to that carried out for the reference strip, and is initiated by incrementing a counter and simultaneously retrieving and storing multiple instantaneous optical density measurements for the lead edge of the input document ($OD_{doc}$). A running average of these instantaneous optical density measurements is also computed and maintained to provide an average optical density for the lead edge of the input document ($OD_{docavg}$). Thereafter, the difference between a present instantaneous optical density measurement and the average optical density for the lead edge of the input document ($OD_{doc}$-$OD_{docavg}$) and an average of this difference ($\Delta_{docavg}$) is computed and maintained. The sequence of computations described above is carried out for each incremental retrieval of an optical density measurement and a counter is concurrently incremented until a predetermined area on the lead edge of the input document has been scanned. In a preferred embodiment, an updated instantaneous optical density measurement and the concommitent calculations described above are made in 5 millisecond intervals until the counter is incremented to 150, equivalent to 750 milliseconds, or approximately ½ to ¾ inch of the lead edge of the input document.

Subsequent to this initial 750 millisecond interval representing scanning of the lead edge of the input document 32, the parameters calculated for the optical density measurements from the reference strip are compared to those from the lead edge of the input document to provide a determination of whether image information is, or is not, present in the lead edge of the input document. More specifically, in the critical decision step, the average difference between instantaneous optical density measurements and average optical density for the case of both the reference strip ($\Delta_{refavg}$) and the lead edge ($\Delta_{docavg}$) are compared. If the average difference between instantaneous optical density measurements and average optical density for the input document lead edge ($\Delta_{docavg}$) is less than or equal to the average difference between instantaneous optical density measurements and average optical density for the reference strip ($\Delta_{refavg}$), a determination that no image information is present in the lead edge of the document is detected. In this case, the bias voltage setting for the illumination lamp 42 (of for other subsystems such as the bias applied to the developer electrode 58 or charge corotron 22)is adjusted to prevent background development in the output copy sheet, as disclosed, for example, in previously referenced U.S. Pat. No. 4,912,508. Conversely, if the average difference between instantaneous optical density measurements and average optical density for the input document lead edge ($\Delta_{docavg}$)is greater than the average difference between instantaneous optical density measurement and average optical density for the reference strip ($\Delta_{refavg}$), an indication that image information is present in the lead edge of the document is assumed. In this case, the bias voltage setting for the illumination lamp 42, as well as other subsystems, as previously discussed, is set to a default setting so as to bypass or suppress any compensation or adjustment for background development which might occur. The analysis described hereinabove may be described with reference to FIG. 2, wherein, if the average difference comparison described above results in a value for $\Delta_{docavg}$ which is greater than the magnitude of $\Delta_{docref}$, such that a graphic plot of $\Delta_{docavg}$ falls outside the envelope shown in FIG. 2 for $\Delta_{docref}$, an indication of image information in the lead edge is interpreted. It will be understood by those of skill in the art that the indication of the presence of image information in the lead edge may lead to further analysis of the optical density measurements which may determine the background color notwithstanding the presence of image information so as to provide alternate bias settings rather than merely applying default voltage settings.

In recapitulation, it should now be clear from the foregoing discussion that the method and apparatus of the present invention provides a novel automatic control system adapted to determine the presence of image information in an optical signal during the processing of the lead edge of an input document. The present invention provides analysis of optical density measurements during scanning of the lead edge of an original input document so that image information on the lead edge of an original input document is not misinterpreted as indicative of a dark background original input document. This improvement is provided by monitoring the optical sensor signal during the lead edge processing of the original input document so that both background development and the loss of image density for images on the lead edge of a document is minimized by setting the exposure lamp voltage, as well as other variable parameters, to predetermined settings in response to the detection of image information in the original input document.

It is, therefore, apparent that there has been provided, in accordance with the present invention, an automatic exposure control system that fully satisfies the aims and advantages set forth hereinabove. While this invention has been described in conjunction with a specific embodiment thereof, it will be evident to those skilled in the art that many alternatives, modifications, and variations are possible to achieve the desired results. Accordingly, the present invention is intended to embrace all such alternatives, modifications, and variations which may fall within the spirit and scope of the following claims.

We claim:

1. An electrostatographic printing apparatus for producing a copy of an original input document having image information and background thereon, comprising:

an imaging member;

an imaging system for transmitting a light image of the original input document onto the imaging member to produce a latent image of the original input document thereon;

sensing means for sensing optical density of the light image being transmitted by said imaging system; and means, coupled to said sensing means, for detecting image information in the transmitted light image.

2. The electrostatographic printing apparatus of claim 1, wherein said imaging system includes an illumination lamp.

3. The electrostatographic printing apparatus of claim 2, further including means, responsive to said detecting means, for varying the electrical bias applied to said illumination lamp.

4. The electrostatographic printing apparatus of claim 1, further including:

means for developing the latent image; and means, responsive to said detecting means, for varying electrical bias applied to said developing means.

5. The electrostatographic printing apparatus of claim 1, further including:

means for applying a charge to said imaging member; and means, responsive to said detecting means, for varying the electrical bias applied to said charge applying means.

6. The electrostatographic printing apparatus of claim 1, wherein said imaging system includes a reference strip for providing a reference optical density to said sensing means.

7. The electrostatographic printing apparatus of claim 6, wherein said imaging system further includes:

means for incrementally scanning said reference strip to provide an instantaneous optical density measurement thereof; and means for incrementally scanning a lead edge of the original input document to provide an instantaneous optical density measurement thereof.

8. The electrostatographic printing apparatus of claim 7, wherein said detecting means includes:

means for retrieving a plurality of instantaneous optical density measurements of the reference strip;

means for calculating an average optical density for the reference strip from the plurality of instantaneous optical density measurements thereof;

means for calculating an average difference between the plurality of instantaneous optical density measurements of the reference strip and the average optical density for the reference strip;

means for retrieving a plurality of instantaneous optical density measurements of the lead edge of the original input document;

means for calculating an average optical density for the lead edge of the original input document from the plurality of instantaneous optical density measurements thereof;

means for calculating an average difference between the plurality of instantaneous optical density measurements of the lead edge of the original input document and the average optical density for the lead edge of the original input document;

means for comparing the average difference between the plurality of instantaneous optical density measurements of the reference strip and the average optical density for the reference strip to the average difference between the plurality of instantaneous optical density measurements of the lead edge of the original input document and the average optical density for the lead edge of the original input document; and means, responsive to said comparing means, for providing a determination of whether image information is present in the lead edge of the original input document.

9. The electrostatographic printing apparatus of claim 8, further including means, operative in response to a determination that image information is present in the lead edge of the original input document, for applying a predetermined bias voltage to said imaging system.

10. The electrostatographic printing apparatus of claim 9, further including means, operative in response to a determination that image information is not present in the lead edge of the original input document, for applying a selectively variable bias voltage to said imaging system relative to the average optical density for the lead edge of the original input document.2.

11. The electrostatographic printing apparatus of claim 8, further including:

means for developing the latent image;

means, operative in response to a determination that image information is present in the lead edge of the original input document, for applying a predetermined bias voltage to said developing means; and means, operative in response to a determination that image information is not present in the lead edge of the original input document, for applying a selectively variable bias voltage to said developing means relative to the average optical density for the lead edge of the original input document.

12. The electrostatographic printing apparatus of claim 8, further including:

means for applying a charge to said imaging member;

means, operative in response to a determination that image information is present in the lead edge of the original input document, for applying a predetermined bias voltage to said charge applying means; and means, operative in response to a determination that image information is not present in the lead edge of the original input document, for applying a selectively variable bias voltage to said charge applying means relative to the average optical density for the lead edge of the original input document.

13. A method of detecting a presence of image information in an original input document having image information and background thereon, comprising the steps of:

incrementally scanning a reference strip to provide an instantaneous optical density measurement thereof;

retrieving a plurality of instantaneous optical density measurements of the reference strip;

calculating an average optical density for the reference strip from the plurality of instantaneous optical density measurements thereof;

calculating an average difference between the plurality of instantaneous optical density measurements of the reference strip and the average optical density for the reference strip;

incrementally scanning a lead edge of the original input document to provide an instantaneous optical density measurement thereof;

retrieving a plurality of instantaneous optical density measurements of the lead edge of the original input document;

calculating an average optical density for the lead edge of the original input document from the plurality of instantaneous optical density measurements thereof;

calculating an average difference between the plurality of instantaneous optical density measurements of the lead edge of the original input document and the average optical density for the lead edge of the original input document;

comparing the average difference between the plurality of instantaneous optical density measurements of the reference strip and the average optical density for the reference strip to the average difference between the plurality of instantaneous optical density measurements of the lead edge of the original input document and the average optical density for the lead edge of the original input document; and providing, in response to said comparing step, a determination of whether image information is present in the lead edge of the original input document.

14. The method of claim 13, further including the step of providing a predetermined voltage output in response to a determination that image information is present in the lead edge of the original input document.

15. The method of claim 14, further including the step of providing a selectively variable voltage output relative to the average optical density for the lead edge of the original input document in response to a determination that image information is not present in the lead edge of the original input document.

* * * * *